US005114468A

United States Patent [19]

Akutsu et al.

[11] Patent Number: 5,114,468

[45] Date of Patent: * May 19, 1992

[54] CU-BASE SINTERED ALLOY

[75] Inventors: Hidetoshi Akutsu, Okegawa; Tohru Kohno; Masato Otsuki, both of Omiya, all of Japan

[73] Assignee: Mitsubishi Materials Corporation, Tokyo, Japan

[ * ] Notice: The portion of the term of this patent subsequent to Oct. 17, 2006 has been disclaimed.

[21] Appl. No.: 474,748

[22] PCT Filed: Oct. 26, 1989

[86] PCT No.: PCT/JP89/01098

§ 371 Date: Mar. 23, 1990

§ 102(e) Date: Mar. 23, 1990

[87] PCT Pub. No.: WO90/04657

PCT Pub. Date: May 3, 1990

[30] Foreign Application Priority Data

| | | | |
|---|---|---|---|
| Oct. 26, 1988 | [JP] | Japan | 63-270109 |
| Oct. 26, 1988 | [JP] | Japan | 63-270110 |
| Oct. 26, 1988 | [JP] | Japan | 63-270111 |
| Nov. 11, 1988 | [JP] | Japan | 63-285214 |

[51] Int. Cl.[5] ..... C22C 29/12

[52] U.S. Cl. ..... 75/234; 75/235

[58] Field of Search ..... 75/234, 235, 247; 420/477, 478, 479, 481; 148/432, 433, 434, 435, 436

[56] References Cited

U.S. PATENT DOCUMENTS

| | | | |
|---|---|---|---|
| 3,779,714 | 12/1973 | Nadkarni et al. | 29/182.5 |
| 3,807,968 | 4/1974 | Finaly et al. | 29/187.5 |
| 4,285,739 | 8/1981 | Deruyttere et al. | 148/11.5 |
| 4,752,334 | 6/1988 | Nadkarni et al. | 75/235 |
| 4,874,439 | 10/1989 | Akutsu | 148/433 |
| 4,995,924 | 2/1991 | Akutsu | 148/433 |

FOREIGN PATENT DOCUMENTS

| | | | |
|---|---|---|---|
| 54-100908 | 8/1979 | Japan . | |
| 56-20137 | 2/1981 | Japan . | |
| 5493159 | 2/1981 | Japan . | |
| 5494721 | 2/1981 | Japan . | |
| 5496067 | 2/1981 | Japan . | |
| 57-076143 | 5/1982 | Japan | 148/434 |

OTHER PUBLICATIONS

DE 38 05 794 (with English Language Abstract).
EP 0 035 602 (with English Language Abstract).
DE 38 09 994 (with English Language Abstract).
European Search Report for European Patent 89 91 1878 (corresponding to JP 8 901 098) including a copy of the claims thereof and Annex to European Search Report EP 89 91 9878.

*Primary Examiner*—Brooks H. Hunt
*Assistant Examiner*—Daniel J. Jenkins
*Attorney, Agent, or Firm*—Scully, Scott, Murphy & Presser

[57] ABSTRACT

The present invention relates to a Cu-based sintered alloy which has a composition containing: Zn: 10–40%; Al: 0.3%–6% oxygen: 0.03–1%; any one selected, as an additional element from the group including at least one of Fe, Ni and Co: 0.1–5%, Mn: 0.1–5%, Si: 0.1–3%, and at least one of W and Mo: 0.1–3%; and the remainder including Cu and inevitable impurities. The alloy is superior in wear resistance particularly in air at temperatures ranging from the ordinary temperature to 400° C., has high strength and high toughness, and further excels in the uniform temporal change characteristics with associated members, as evaluated by its friction coefficient. The invention relates also to parts for automotive equipment made of this Cu-base sintered alloy, such as synchronizer rings for transmission, valveguides for engines, bearings for turbo-chargers and so forth.

28 Claims, No Drawings

CU-BASE SINTERED ALLOY

TECHNICAL FIELD

This invention relates to a Cu-based sintered alloy which excels particularly in wear resistance in air at temperatures ranging from the ordinary temperature to 400° C., is of high strength and high toughness, and further has superior uniform temporal change characteristics with respect to associated members, as measured by the coefficient of friction; and to parts for automotive equipment of this Cu-based sintered alloy, such as synchronizer rings for transmissions, valve guides for engines, bearings for turbochargers, and the like.

BACKGROUND ART

Hitherto, for manufacture of the parts of the various automotive equipment mentioned above, it has been proposed to use Cu-based sintered alloy having the representative composition of Cu—28% Zn—6% Al by weight % (hereafter, the symbol % represents weight %).

The above conventional Cu-based alloy has superior uniform temporal change chracteristics with respect to associated members because it is a sintered one, but it does not possess sufficient wear resistance, strength and toughness. The alloy, therefore, cannot meet the design requirements of compactness, light-weightness and increase of output power for the various equipment of recent years, and it has been keenly desired to develop a Cu-based sintered alloy having better wear resistance, strength and toughness.

DISCLOSURE OF THE INVENTION

Therefore, in light of the facts described above, the present inventors have directed their attention particularly to the above conventional Cu-based sintered alloy and have conducted research to develop a Cu-based sintered alloy which possesses better wear resistance, strength and toughness. As a result, they have learned that a certain Cu-based sintered alloy has excellent wear resistance in air at temperatures ranging from the ordinary temperature to 400° C., high strength and high toughness, and therefore, is usable for manufacturing parts which can meet the design requirements of compactness, light-weightness and increase of output power for the various equipment. The alloy has a composition containing:

Zn 10–40%, Al: 0.3–6%, oxygen: 0.03–1%, at least one additional element selected from the group including at least one of Fe, Ni and Co: 0.1–5%; Mn: 0.1–5%; Si: 0.1–3%; and at least one of W and Mo: 0.1–3%, and the remainder consisting of Cu and inevitable impurities. The sintered alloy has a structure wherein fine oxides including aluminum oxide ($Al_2O_3$) as the main constituent and intermetallic compounds are uniformly dispersed in a matrix.

This invention has been carried out on the basis of the above knowledge. The Cu-based sintered alloy according to the invention, with the above composition, comes to have a structure in the matrix of which the oxides mainly consisting of $Al_2O_3$ are distributed with a granule size ranging from 1 to 40 um so as to comprise 0.5–15% of surface area ratio. The intermetallic compounds are distributed with a granule size from 1 to 25 um and are uniformly dispersed comprising 1–10% of the surface area ratio. These oxides and intermetallic compounds cause the wear resistance to be remarkably improved, and particularly by the uniform dispersion of the oxides, the resistance to heat damage is improved in addition to the improvement in the heat resistance of contacting surfaces. Hence, the alloy of the present invention exhibits excellent wear resistance, even under high loads. Accordingly, the parts for automotive equipment made of the above Cu-based sintered alloy excel likewise in wear resistance and so forth, and can sufficiently meet the design requirements of compactness, light-weightness and increase of output power for the equipment.

Subsequently, description will be made concerning the reasons for limiting the component constitution in the Cu-based sintered alloy of the invention as described above.

(a) Zn

The Zn component has the function of forming, together with Cu and Al, the matrix to enhance the strength and toughness of the alloy. When its content is less than 10%, however, the desired effect cannot be obtained. On the other hand, if its content exceeds 40%, a deteriorating phenomenon arises. Thus, its content is set to be 10–40%.

(b) Al

The Al component has, in addition to the function of forming, together with Cu and Zn, the matrix of high strength and high toughness as described above, the function of combining with oxygen to form an oxide, thereby improving the wear resistance under high temperature conditions, as well as at the ordinary temperature. When its content is less than 0.3%, however, the desired effect cannot be obtained. On the other hand, if its content exceeds 6%, the toughness of the matrix becomes lower. Accordingly, its content is set at 0.3–6%.

(c) Oxygen

Oxygen has the function of combining with Al, as described above, and with W, Mo and Cr, and further with Si, which are included as needed, to form oxides finely and uniformly dispersed in the matrix, thereby improving the wear resistance, particularly under high load conditions through improvement in resistance to heat damage and heat resistance. When its content is less than 0.03%, however, the formation of the oxides is too little so that the desired wear resistance cannot be ensured. On the other hand, if its content is over 1%, not only do the oxides exceed 40 um in granule size, and thereby become coarse, but also they exceed 15% of surface area ratio to become too much, so that the strength and toughness of the alloy is lowered and further, its abrasiveness to adjacent members increases. Accordingly, its content is set at 0.03–1%.

(d) Fe, Ni and Co

These components have the function of dispersing in the matrix to enhance the strength and toughness of the alloy, and further, forming in combination with Cu and Al, fine intermetallic compounds dispersed in the matrix to improve wear resistance. When its content is less than 0.1%, however, the desired effect of the function cannot be obtained. On the other hand, if its content exceeds 5%, the toughness becomes lower. Thus, its content is set to be 0.1–5%.

(e) Mn

The Mn component has the function of forming, in combination with Si, the intermetallic compound finely dispersed in the matrix to enhance wear resistance, and partly making a solid solution in the matrix to enhance its strength. When its content is less than 0.1%, however, the desired effect cannot be obtained. On the other hand, if its content exceeds 5%, the toughness becomes lower. Accordingly, its content is set at 0.1–5%.

(f) Si

The Si component combines with Mn, W and Mo, and further with Cr which is included as needed, to form the hard and fine intermetallic compounds. Additionally, the Si component forms, in combination with oxygen, a complex oxide with Al, etc. to improve the wear resistance. Particularly by the existence of the complex oxide as described above, the resistance to heat damage and heat resistance at contacting surfaces are enhanced. The alloy, therefore, exhibits excellent wear resistance, for instance, even under high load conditions. When its content is less than 0.1%, however, the desired wear resistance cannot be ensured. On the other hand, if its content exceeds 3%, the toughness becomes lowered. For this reason, its content is set at 0.1–3%.

(g) W and Mo

These components have, in addition to the function of enhancing the strength, the function of combining with Fe, Ni and Co, which are included as needed, to form the intermetallic compounds, and further combining with oxygen to form the fine oxides, thereby improving the wear resistance. When its content is less than 0.1%, however, the desired strength and wear resistance cannot be ensured. On the other hand, if its content is over 3%, the toughness becomes lowered. Thus, its content is set at 0.1–3%.

In the foregoing, it sometimes occurs that the Cu-based sintered alloy according to the invention includes P, Mg and Pb as inevitable impurities. When the amount of these impurities is less than 1.5% in total, however, the alloy characteristics do not deteriorate, so that their inclusion is permissible.

BEST MODE FOR CARRYING OUT THE INVENTION

The Cu-based sintered alloy of this invention has the composition as described above, which includes Zn: 10–40%, Al: 0.3–6%, oxygen: 0.03–1%, at least one additional element selected from the group including at least one of Fe, Ni and Co: 0.1–5%; Mn: 0.1–5%; Si: 0.1–3%; and at least one of W and Mo: 0.1–3%, and the remainder consisting of Cu and inevitable impurities. Furthermore, it is preferable to replace a part of the above Cu as necessary with Sn: 0.1–4%; Mn: 0.1–5%; Si: 0.1–3%; one or more elements selected from the group including W, Mo and Cr: 0.1–5%; or Cr: 0.1–3%. Hereinafter, the reasons why the above components are limited as above will be described.

(h) Sn

The Sn component has the function of making a solid solution in the matrix to strengthen the same and further heighten the resistance to heat damage under high load conditions, thereby contributing to the improvement of the wear resistance. Therefore, the component is included as necessary. When the content is less than 0.1%, however, the desired effect cannot be obtained. On the other hand, if the content exceeds 4%, the toughness becomes lower and, particularly, the heat resistance at contacting surfaces is lowered, so that the wear resistance deteriorates. Thus, its content is set at 0.1–4%.

(i) Mn

The Mn component has the function of making a solid solution in the matrix to heighten the strength, and therefore is included as necessary even when no Si is included. When its content is less than 0.1%, the desired effect of heightening the strength cannot be obtained. On the other hand, if its content exceeds 5%, the toughness is lowered and further the heat resistance at contacting surfaces becomes lower, so that the desired wear resistance cannot be ensured. Thus, its content is set at 0.1–5%.

(j) W, Mo and Cr

These components have the function of combining with Fe, Ni and Co to form the fine intermetallic compounds, and further combining with oxygen to form the fine oxides, thereby improving the wear resistance. The components, therefore, are included as occasion demands. When the content is less than 0.1%, the desired effect cannot be obtained in heightening wear resistance. On the other hand, if the content exceeds 5%, the toughness becomes lower. Accordingly, their content is set at 0.1–5%.

(k) Cr The Cr component has the function of forming, in combination with iron family metals which are included as necessary as in the case of W and Mo, the intermetallic compounds and further the oxides to improve the wear resistance. For this reason, Cr is included as necessary. When the content is less than 0.1%, the desired effect cannot be obtained in the wear resistance. On the other hand, if its content exceeds 3%, the toughness becomes lower. Thus, its content is set to be 0.1–3%.

EXAMPLES

Hereinafter, the Cu-based sintered alloy according to the invention will be concretely described through the examples thereof.

EXAMPLE 1

Prepared as starting material powders were two varieties each of Cu-Al alloy (Al: 50% included) powders, Cu powders, Zn powders, Al powders, Fe powders, Ni powders, Co powders, Mn powders, W powders, Mo powders, Cr powders, and Sn powders. Each of these powders is of particle size less than 200 mesh, and the two varieties of the same sort of powders are made to have $O_2$ contents of 4% and 1%, respectively, by adjustment of the thicknesses of oxidized surface layers. These starting material powders were blended into the compositions shown in TABLES 1-1 to 1-3, and wet pulverized and mixed together for 72 hours in a ball mill. The mixtures after having been dried were pressed into green compacts under a predetermined pressure within the range of 4–6 ton/cm$^2$. Then, the green compacts were sintered in an atmosphere of $H_2$ gas, which has the dew point: 0°–30° C., at a predetermined temperature within the range of 800°–900° C. for one and half hours to produce Cu-based sintered alloys 1–36 according to the present invention, comparative Cu-based sintered alloys 1–6, and the Cu-based sintered alloys according to the conventional art. The alloys had the sizes of outer diameter: 75 mm×inner diameter: 65 mm×thickness: 8.5 mm for measurement of pressure destructive forces, of width: 10 mm×thickness: 10 mm×length: 40 mm for wearing tests, and of outer diameter: 10 mm×height: 20 mm for measurement of friction coefficients, respectively, and each of the alloys had substantially the same component composition as the blended composition.

In the foregoing, Cu-based sintered alloys 1–36 according to the invention had the structures wherein the oxides and intermetallic compounds were uniformly dispersed in the matrices.

Each of the comparative Cu-based sintered alloys 1-6 deviated from the range of the invention in the content of any one of its constituent components (the component marked with in TABLE 1).

Subsequently, with respect to the various kinds of the Cu-based sintered alloys obtained in consequence of the above, pressure destructive forces were measured for the purpose of evaluation of strength and toughness. Furthermore, for the purpose of evaluation of wear resistance, block-on-ring tests were conducted to measure specific wear amounts under the conditions of:

shape of test piece: 8 mm×8 mm×30 mm;

associated member: hardened ring of SCr 420 material sized to diameter: 30 mm×width: 5 mm;

oil: 65 W gear oil;

oil temperature: 50° C.;

Sliding speed: 2 m/sec.;

final load: 3 Kg; and, sliding distance: 1.5 Km.

Moreover, for the purpose of evaluation of the uniform temporal change properties with respect to associated members, pin-wearing tests were conducted to calculate friction coefficients from a torque meter under the conditions of:

shape of test piece: pin having diameter of 3 mm;

associated member: hardened disk of SCr 420 material;

oil: 65 W gear oil;

oil temperature: 50° C.;

sliding speed: 4 m/sec.;

pressing force: 1.5 Kg; and, sliding distance: 1.5 Km.

The results of these tests are shown in TABLES 1-1 to 1-3.

EXAMPLE 2

Prepared as starting material powders were two varieties each of Cu-Al alloy (Al: 50% included) powders, Cu powders, Zn powders, Al powders, Si powders, W powders, Mo powders, Fe powders, Ni powders, Co powders, Cr powders, and Sn powders. Each of these powders is of particle size less than 200 mesh, and the two varieties of the same sort of powders are made to have $O_2$ contents of 4% and 1%, respectively, by adjustment of the thicknesses of oxidized surface layers. These starting material powders were blended into the compositions shown in TABLES 2-1 and 2-2. The powders thus blended were pulverized and mixed together, and sintered after having been dried and pressed into green compacts in the same manner as in the case of Example 1 to produce Cu-based sintered alloys 1-30 according to the present invention, comparative Cu-based sintered alloys 1-7, and the Cu-based sintered alloys according to the conventional art. The alloys had the sizes of outer diameter 72 mm×inner diameter: 62 mm×thickness: 8.2 mm for measurement of pressure destructive forces, of width: 10 mm×thickness: 10 mm×length: 40 mm for wearing tests, and of outer diameter: 10 mm×height: 20 mm for measurement of friction coefficients, respectively, and each of the alloys had substantially the same component composition as the blended composition.

In the foregoing, Cu-based sintered alloys 1-30 according to the invention had structures wherein the oxides and intermetallic compounds were uniformly dispersed in the matrices.

Each of the comparative Cu-based sintered alloys 1-7 deviated from the range of the invention in the content of any one of its constituent components (the component marked with in TABLE 2).

Subsequently, with respect to the various kinds of the Cu-based sintered alloys obtained in consequence of the above, pressure destructive forces were measured for the purpose of evaluation of strength and toughness. Furthermore, for the purpose of evaluation of wear resistance, block-on-ring tests were conducted to measure specific wear amounts under the conditions of:

shape of test piece: 8 mm×8 mm×30 mm;

associated member: ring of S45C material sized to diameter: 30 mm×width: 5 mm;

oil: 20 W gear oil;

oil temperature: 75° C.;

sliding speed: 6 m/sec.;

final load: 4 Kg; and, sliding distance: 1.5 Km.

Moreover, for the purpose of evaluation of the uniform temporal change characteristices with respect to associated members, pin-wearing tests were conducted to calculate friction coefficients from a torque meter under the conditions of:

shape of test piece: pin having diameter of 3 mm;

associated member: disk of S45C material;

oil: 20 W engine oil;

oil temperature: 75° C.;

sliding speed: 6 m/sec.;

pressing force: 2 Kg; and, sliding distance: 1.5 Km.

The results of these tests are shown in TABLES 2-1 to 2-3.

EXAMPLE 3

Prepared as starting material powders were two varieties each of Cu-Al alloy (Al: 50% included) powders, Cu powders, Zn powders, Al powders, Mn powders, Si powders, Fe powders, Ni powders, Co powders, and Cr powders. Each of these powders is of particle size less than 200 mesh, and the two varieties of the same sort of powders are made to have $O_2$ contents of 4% and 2%, respectively, by adjustment of the thicknesses of oxidized surface layers. These starting material powders were blended into the compositions shown in TABLES 3-1 and 3-2. The powders thus blended were pulverized and mixed together, and sintered after having been dried and press-molded into green compacts in the same manner as in the case of Example 1 to produce Cu-based sintered alloys 1-17 according to the present invention, comparative Cu-based sintered alloys 1-7, and the cu-based sintered alloys according to the conventional art. The alloys had the sizes of outer diameter: 71 mm×inner diameter: 63 mm×thickness: 8 mm for measurement of pressure destructive forces, of width: 10 mm×thickness: 10 mm×length: 40 mm for wearing tests, and of outer diameter: 10 mm×height: 20 mm for measurement of friction coefficients, respectively, and each of the alloys had substantially the same component composition as the blended composition.

In the foregoing, Cu-based sintered alloys 1-17 according to the invention had the structures wherein the oxides and intermetallic compounds were uniformly dispersed in the matrices.

Each of the comparative Cu-based sintered alloys 1-7 deviated from the range of the invention in the content of any one of its constituent components (the component marked with TABLE 3).

Subsequently, with respect to the various kinds of the Cu-based sintered alloys obtained in consequence of the above, pressure destructive forces were measured for the purpose of evaluation of strength and toughness. Furthermore, for the purpose of evaluation of wear resistance, block-on-ring tests were conducted to measure specific wear amounts under the conditions of:

shape of test piece: 8 mm×8 mm×30 mm;

associated member: ring of S35C material sized to diameter: 30 mm×width: 5 mm;

oil: 10 W engine oil;

oil temperature: 85° C.;

sliding speed: 10 m/sec.;

final load: 4 Kg; and, sliding distance: 1.5 Km.

Moreover, for the purpose of evaluation of the uniform temporal change characteristics with respect to associated members, pin-wearing tests were conducted to calculate friction coefficients from a torque meter under the conditions of:

shape of test piece: pin having diameter of 2.5 mm;

associated member: disk of S35C material;

oil: 10 W engine oil;

oil temperature: 85° C.;

sliding speed: 10 m/sec.;

pressing force: 2 Kg; and, sliding distance: 1.5 Km.

The results of these tests are shown in TABLES 3-1 to 3-3.

EXAMPLE 4

Prepared as starting material powders were two varieties each of Cu-Al alloy (Al: 50% included) powders, Cu powders, Zn powders, Al powders, Mn powders, Si powders, W powders, Mo powders, Fe powders, Ni powders, Co powders, Cr powders, and Sn powders. Each of these powders is of particle size less than 200 mesh, and the two varieties of the same sort of powders are made to have $O_2$ contents of 4% and 2%, respectively, by adjustment of the thicknesses of oxidized surface layers. These starting material powders were blended into the compositions shown in TABLES 4-1 and 4-2. 2. The powders thus blended were pulverized and mixed together, and sintered after having been dried and pressed into green compacts in the same manner as in the case of Example 1 to produce Cu-based sintered alloys 1–30 according to the present invention, comparative Cu-based sintered alloys 1–6, and the Cu-based sintered alloys according to the conventional art. The alloys had the sizes of outer diameter: 70 mm×inner diameter: 62 mm×thickness: 8 mm for measurement of pressure destructive forces, of width: 10 mm×thickness: 10 mm×length: 40 mm for wearing tests, and of outer diameter: 10 mm×height: 20 mm for measurement of friction coefficients, respectively, and each of the alloys had substantially the same composition as the blended composition.

In the foregoing, Cu-based sintered alloys 1–30 according to the invention had the structures wherein the oxides and intermetallic compounds were uniformly dispersed in the matrices.

Each of the comparative Cu-based sintered alloys 1–6 deviated from the range of the invention in the content of any one of its constituent components (the component marked with in TABLE 4).

Subsequently, with respect to the various kinds of the Cu-based sintered alloys obtained in consequence of the above, pressure destructive forces were measured for the purpose of evaluation of strength and toughness. Furthermore, for the purpose of evaluation of wear resistance, block-on-ring tests were conducted to measure specific wear amounts under the conditions of:

shape of test piece: 8 mm×8 mm×30 mm;

associated member: ring of SUH36 material sized to diameter: 30 mm×width: 5 mm;

oil: 5 W engine oil;

oil temperature: 80° C.;

sliding speed: 8 m/sec.;

final load: 5 Kg; and, sliding distance: 1.5 Km.

Moreover, for the purpose of evaluation of the complementary characteristics with associated members, pin-wearing tests were conducted to calculate friction coefficients from a torque meter under the conditions of:

shape of test piece: pin having diameter of 2 mm;

associated member: disk of SUH36 material;

oil: 5 W engine oil;

oil temperature: 80° C.;

sliding speed: 8 m/sec.;

pressing force: 2 Kg; and, sliding distance: 1.5 Km.

The results of these tests are shown in TABLES 4-1 to 4-3.

From the results shown in TABLE 1–TABLE 4, the following is apparent. The Cu-based sintered alloys according to the present invention have friction coefficients which are equivalent to those of the conventional Cu-based sintered alloys. This means that they are excellent in regard to uniform temporal change characteristics with respect to associated members. Also, they have superior wear resistance, strength and toughness as compared with the conventional Cu-based sintered alloys. In contrast, as seen in the comparative Cu-based sintered alloys, if the content of even any one of the constituent components is out of the range of the present invention, at least one property of the wear resistance, the strength and the toughness tends to deteriorate. Accordingly, with the parts for various automotive equipment made of the Cu-based sintered alloy of the invention, such as synchronizer rings for transmissions, etc., excellent wear resistance and so forth are exhibited and the design requirements of compactness, light-weightness and increase in output power of the equipment can be sufficiently met.

INDUSTRIAL APPLICABILITY

The Cu-based sintered alloy according to the invention has excellent wear resistance, has high strength and high toughness, and is superior in uniform temporal change characteristic with respect to associated members Therefore, with the parts for various automotive equipment made of this Cu-based sintered alloy, such as valve-guides, bearings for turbo-chargers and the like, the applicability useful in industry can be provided such that superior wear resistance and so forth are exhibited in air at temperatures ranging from the ordinary temperature to 400° C., the design requirements of compactness, light-weightness and increase in output power of the equipment can be sufficiently met, and further the excellent performance can be exhibited for a long period of time when put into practical use.

TABLE 1

| TYPE | BLENDED COMPOSITION (wt %) Zn | Al | Fe | Ni | Co | OXYGEN | Mn | Sn | W | Mo | Cr | Cu + IMPURITY | PRESSURE DESTRUCTIVE LOAD (Kg) | SPECIFIC WEAR AMOUNT ($\times 10^{-7}$ mm$^2$/Kg · m) | FRICTION COEFFICIENT |
|---|---|---|---|---|---|---|---|---|---|---|---|---|---|---|---|
| | | | | | | Cu-BASED SINTERED ALLOY ACCORDING TO INVENTION | | | | | | | | | |
| 1 | 10 | 3 | 2 | 1 | — | 0.4 | — | — | — | — | — | REMAINDER | 80 | 15 | 0.08 |
| 2 | 20 | 2.5 | — | — | 3 | 0.2 | — | — | — | — | — | REMAINDER | 95 | 16 | 0.07 |
| 3 | 30 | 2.5 | 1 | 1 | 1 | 0.2 | — | — | — | — | — | REMAINDER | 110 | 16 | 0.07 |
| 4 | 40 | 3 | 1 | — | 4 | 0.3 | — | — | — | — | — | REMAINDER | 130 | 12 | 0.08 |
| 5 | 32 | 0.3 | — | 5 | — | 0.1 | — | — | — | — | — | REMAINDER | 95 | 25 | 0.06 |
| 6 | 26 | 6 | 0.1 | — | 0.1 | 0.9 | — | — | — | — | — | REMAINDER | 100 | 13 | 0.09 |
| 7 | 30 | 3 | — | — | 0.1 | 0.3 | — | — | — | — | — | REMAINDER | 105 | 21 | 0.08 |
| 8 | 31 | 3.5 | — | 0.1 | — | 0.4 | — | — | — | — | — | REMAINDER | 105 | 20 | 0.07 |
| 9 | 28 | 2.8 | 5 | — | — | 0.3 | — | — | — | — | — | REMAINDER | 120 | 11 | 0.08 |
| 10 | 30 | 1.0 | 2.5 | — | — | 0.03 | — | — | — | — | — | REMAINDER | 105 | 28 | 0.06 |
| 11 | 33 | 3 | 1 | 1 | 1 | 1 | — | — | — | — | — | REMAINDER | 100 | 14 | 0.09 |
| 12 | 13 | 1.5 | 2 | 2 | 1 | 0.2 | 0.1 | — | — | — | — | REMAINDER | 80 | 20 | 0.08 |
| 13 | 38 | 2.5 | — | 3 | — | 0.3 | 2 | — | — | — | — | REMAINDER | 110 | 15 | 0.09 |
| 14 | 25 | 3 | 1 | — | 2 | 0.3 | 5 | — | — | — | — | REMAINDER | 100 | 14 | 0.09 |
| 15 | 39 | 5.8 | 4 | 1 | — | 0.8 | — | 0.1 | — | — | — | REMAINDER | 125 | 9 | 0.09 |
| 16 | 30 | 3 | 1 | — | — | 0.4 | — | 2 | — | — | — | REMAINDER | 100 | 19 | 0.09 |
| 17 | 27 | 2 | — | 0.3 | — | 0.3 | — | 4 | — | — | — | REMAINDER | 95 | 23 | 0.09 |
| 18 | 30 | 2.5 | — | — | 4 | 0.3 | — | — | 0.1 | — | — | REMAINDER | 110 | 14 | 0.07 |
| 19 | 28 | 3.1 | 2 | 1 | — | 0.9 | — | — | 5 | — | — | REMAINDER | 95 | 5 | 0.09 |
| 20 | 30 | 2 | 1 | 2 | — | 0.08 | — | — | — | 0.1 | — | REMAINDER | 115 | 16 | 0.06 |
| 21 | 38 | 0.5 | 0.5 | — | — | 0.1 | — | — | — | 5 | — | REMAINDER | 85 | 13 | 0.07 |
| 22 | 14 | 5.8 | 3 | 2 | — | 0.5 | — | — | — | — | 0.1 | REMAINDER | 95 | 8 | 0.09 |
| 23 | 25 | 3 | 1 | 1 | 1 | 0.9 | — | — | — | — | 5 | REMAINDER | 95 | 4 | 0.09 |
| 24 | 30 | 3 | 2 | 1 | 1 | 0.6 | — | — | 2 | 1 | — | REMAINDER | 105 | 6 | 0.09 |
| 25 | 28 | 3 | 1.5 | 1 | — | 0.4 | — | — | 1 | 1 | 1 | REMAINDER | 95 | 7 | 0.08 |
| 26 | 30 | 2 | — | 2 | 1 | 0.3 | 1 | 1 | — | — | — | REMAINDER | 110 | 10 | 0.08 |
| 27 | 30 | 3 | 2 | — | — | 0.3 | 0.5 | — | 1 | — | — | REMAINDER | 110 | 14 | 0.08 |
| 28 | 30 | 2.5 | 1 | 1 | — | 0.4 | 3 | — | — | 0.5 | 0.5 | REMAINDER | 105 | 10 | 0.08 |
| 29 | 29 | 3 | — | 2 | — | 0.07 | 1 | — | 0.5 | 1 | 1 | REMAINDER | 105 | 10 | 0.07 |
| 30 | 27 | 3 | — | 2 | 1 | 0.2 | — | 0.5 | — | 3 | — | REMAINDER | 110 | 8 | 0.08 |
| 31 | 25 | 4 | 2 | 2 | 1 | 0.4 | — | 1 | 2 | 2 | 1 | REMAINDER | 115 | 7 | 0.08 |
| 32 | 32 | 3 | 1 | 1 | — | 0.3 | — | 4 | — | — | 3 | REMAINDER | 105 | 6 | 0.09 |
| 33 | 30 | 3 | 0.5 | 0.5 | 0.5 | 0.2 | 0.5 | 1 | — | 1 | — | REMAINDER | 110 | 14 | 0.08 |
| 34 | 28 | 2.5 | — | 1.5 | 1.5 | 0.1 | 1 | 1 | — | 1 | 2 | REMAINDER | 105 | 10 | 0.07 |
| 35 | 30 | 2.5 | 1.5 | 1.5 | 1.5 | 0.5 | 5 | 0.5 | 1 | 2 | — | REMAINDER | 110 | 8 | 0.08 |
| 36 | 30 | 3 | 2 | 1 | — | 0.4 | 3 | 2 | 1 | 1 | 1 | REMAINDER | 100 | 11 | 0.09 |
| | | | | | | COMPARATIVE Cu-BASED SINTERED ALLOY | | | | | | | | | |
| 1 | 8* | 3 | 2.5 | — | — | 0.3 | — | — | — | — | — | REMAINDER | 45 | 42 | 0.05 |
| 2 | 43* | 3 | — | 2.5 | — | 0.4 | — | — | — | — | — | REMAINDER | 50 | 39 | 0.04 |
| 3 | 30 | —* | 1.5 | 1 | 1 | 0.05 | — | — | — | — | — | REMAINDER | 40 | 55 | HEAT DAMAGE |
| 4 | 30 | 3 | —* | —* | —* | 0.3 | — | — | — | — | — | REMAINDER | 60 | 50 | 0.08 |
| 5 | 25 | 3 | — | 2 | — | —* | — | — | — | — | — | REMAINDER | 105 | 48 | HEAT DAMAGE |
| 6 | 30 | 2.5 | 2.5 | — | — | — | 1.3* | — | — | — | — | REMAINDER | 40 | 30 | 0.06 |
| | | | | | | CONVENTIONAL Cu-BASED SINTERED ALLOY | | | | | | | | | |
| | 28 | 6 | — | — | — | — | — | — | — | — | — | REMAINDER | 32 | 68 | 0.07 |

(*OUT OF RANGE OF INVENTION)

TABLE 2

| TYPE | BLENDED COMPOSITION (wt %) Zn | Al | Si | W | Mo | Fe | Ni | Co | OXYGEN | Sn | Cr | Cu + IMPURITY | PRESSURE DESTRUCTIVE LOAD (Kg) | SPECIFIC WEAR AMOUNT ($\times 10^{-7}$ mm$^2$/Kg · m) | FRICTION COEFFICIENT |
|---|---|---|---|---|---|---|---|---|---|---|---|---|---|---|---|
| | | | | | | Cu-BASED SINTERED ALLOY ACCORDING TO INVENTION | | | | | | | | | |
| 1 | 10 | 3 | 1.5 | 2 | — | — | — | 3 | 0.4 | — | — | REMAINDER | 80 | 17 | 0.07 |
| 2 | 20 | 3 | 1.5 | — | 1.5 | 1 | 1 | — | 0.3 | — | — | REMAINDER | 95 | 18 | 0.06 |
| 3 | 30 | 3 | 1.5 | 1 | 1 | — | 5 | — | 0.3 | — | — | REMAINDER | 120 | 16 | 0.06 |
| 4 | 40 | 2.5 | 2 | — | 2 | 3 | — | — | 0.5 | — | — | REMAINDER | 125 | 17 | 0.07 |
| 5 | 25 | 0.3 | 2 | 0.5 | 0.5 | 1 | 1 | 3 | 0.1 | — | — | REMAINDER | 100 | 25 | 0.05 |
| 6 | 30 | 6 | 1.5 | — | 1 | 1 | — | 1 | 0.9 | — | — | REMAINDER | 105 | 13 | 0.08 |
| 7 | 30 | 2.5 | 0.1 | 0.5 | — | — | 2 | 1 | 0.3 | — | — | REMAINDER | 90 | 17 | 0.06 |
| 8 | 25 | 3 | 3 | — | 1 | — | — | 5 | 0.4 | — | — | REMAINDER | 115 | 10 | 0.07 |
| 9 | 30 | 2.5 | 1.5 | 0.1 | — | 0.5 | 0.5 | — | 0.3 | — | — | REMAINDER | 95 | 20 | 0.06 |
| 10 | 30 | 2 | 2 | — | 0.1 | — | 1 | 1 | 0.4 | — | — | REMAINDER | 100 | 19 | 0.06 |
| 11 | 25 | 3 | 2.5 | 3 | — | 2 | — | 1 | 0.4 | — | — | REMAINDER | 105 | 10 | 0.06 |
| 12 | 20 | 5.5 | 2.5 | — | 3 | — | 0.5 | 1 | 0.6 | — | — | REMAINDER | 110 | 9 | 0.07 |
| 13 | 35 | 1 | 0.5 | 1 | 1 | 5 | — | — | 0.1 | — | — | REMAINDER | 100 | 18 | 0.05 |
| 14 | 30 | 3 | 0.5 | 2 | — | — | 0.1 | — | 0.3 | — | — | REMAINDER | 110 | 21 | 0.06 |

TABLE 2-continued

| TYPE | BLENDED COMPOSITION (wt %) Zn | Al | Si | W | Mo | Fe | Ni | Co | OXY-GEN | Sn | Cr | Cu + IMPURITY | PRESSURE DESTRUC-TIVE LOAD (Kg) | SPECIFIC WEAR AMOUNT ($\times 10^{-7}$ mm$^2$/Kg · m) | FRIC-TION COEF-FI-CIENT |
|---|---|---|---|---|---|---|---|---|---|---|---|---|---|---|---|
| 15 | 40 | 6 | 3 | — | 2 | — | — | 0.1 | 0.9 | — | — | REMAINDER | 120 | 19 | 0.08 |
| 16 | 25 | 0.5 | 0.2 | 0.1 | 0.1 | — | — | 1 | 0.03 | — | — | REMAINDER | 100 | 22 | 0.06 |
| 17 | 25 | 4 | 3 | 2 | 0.5 | 1 | 1 | 1 | 1 | — | — | REMAINDER | 90 | 10 | 0.08 |
| 18 | 30 | 2 | 2 | 1 | 1 | 1 | 1 | 1 | 0.4 | 0.1 | — | REMAINDER | 105 | 14 | 0.06 |
| 19 | 35 | 1.5 | 2 | — | 2 | 1 | — | — | 0.2 | 1 | — | REMAINDER | 100 | 12 | 0.06 |
| 20 | 20 | 5 | 1.5 | — | 0.5 | 1 | — | — | 0.6 | 2 | — | REMAINDER | 110 | 11 | 0.07 |
| 21 | 30 | 3 | 0.5 | 2 | — | 1 | 3 | 1 | 0.3 | 3 | — | REMAINDER | 115 | 9 | 0.06 |
| 22 | 30 | 1 | 1.5 | 1 | 1 | 2 | 1 | 1 | 0.1 | 4 | — | REMAINDER | 95 | 9 | 0.05 |
| 23 | 20 | 2.5 | 2 | — | 1.5 | 2 | — | 1 | 0.3 | — | 0.1 | REMAINDER | 95 | 18 | 0.06 |
| 24 | 20 | 1 | 2 | 1.5 | — | — | 2 | — | 0.5 | — | 1 | REMAINDER | 90 | 15 | 0.07 |
| 25 | 25 | 3 | 1.5 | 2 | — | 1 | 1 | 1 | 0.7 | — | 2 | REMAINDER | 100 | 12 | 0.07 |
| 26 | 25 | 1.5 | 1 | — | 2 | 1 | 1 | 3 | 0.6 | — | 3 | REMAINDER | 95 | 9 | 0.08 |
| 27 | 35 | 2 | 2.5 | 1.5 | 1 | — | 2 | 1 | 0.3 | 0.5 | 0.5 | REMAINDER | 110 | 13 | 0.06 |
| 28 | 35 | 1.5 | 2 | 1 | — | 3 | — | — | 0.4 | 2 | 0.1 | REMAINDER | 105 | 14 | 0.06 |
| 29 | 25 | 1.5 | 1 | 0.5 | 2 | 1 | — | 0.5 | 0.4 | 0.1 | 2 | REMAINDER | 100 | 10 | 0.06 |
| 30 | 30 | 1 | 1.5 | 1.5 | 1 | 1 | — | 0.5 | 0.3 | 4 | 1 | REMAINDER | 95 | 9 | 0.07 |
| | | | | | | COMPARATIVE Cu-BASED SINTERED ALLOY | | | | | | | | | |
| 1 | 7* | 3 | 1.5 | 1 | 2.5 | 2 | 1 | 1 | 0.4 | — | — | REMAINDER | 50 | 41 | 0.04 |
| 2 | 25 | —* | 1.5 | — | 3 | 1.5 | 1 | 1 | 0.1 | — | — | REMAINDER | 45 | 58 | HEAT DAM-AGE |
| 3 | 25 | 2.5 | —* | — | 3 | 1 | 1 | 1 | 0.3 | — | — | REMAINDER | 95 | 47 | 0.05 |
| 4 | 30 | 3 | 2 | —* | —* | 1 | 1 | 1 | 0.4 | — | — | REMAINDER | 100 | 50 | 0.06 |
| 5 | 25 | 3 | 1.5 | 1 | 2.5 | —* | —* | —* | 0.4 | — | — | REMAINDER | 65 | 48 | 0.08 |
| 6 | 30 | 2.5 | 1.5 | 2 | 1 | 1 | 1 | 2 | —* | — | — | REMAINDER | 110 | 49 | HEAT DAM-AGE |
| 7 | 30 | 2.5 | 1.5 | 2 | 1 | 1 | 1 | 1 | 1.2* | — | — | REMAINDER | 45 | 27 | 0.04 |
| | | | | | | CONVENTIONAL Cu-BASED SINTERED ALLOY | | | | | | | | | |
| | 28 | 6 | — | — | — | — | — | — | — | — | — | REMAINDER | 40 | 64 | 0.06 |

(*OUT OF RANGE OF INVENTION)

TABLE 3

| TYPE | BLENDED COMPOSITION (wt %) Zn | Al | Mn | Si | Fe | Ni | Co | OXY-GEN | Cr | Cu + IMPURITY | PRESSURE DESTRUC-TIVE LOAD (Kg) | SPECIFIC WEAR AMOUNT ($\times 10^{-7}$ mm$^2$/Kg · m) | FRICTION COEFFICIENT |
|---|---|---|---|---|---|---|---|---|---|---|---|---|---|
| | | | | | | Cu-BASED SINTERED ALLOY ACCORDING TO INVENTION | | | | | | | |
| 1 | 10 | 3 | 2.5 | 1.5 | — | 3 | — | 0.4 | — | REMAINDER | 90 | 17 | 0.07 |
| 2 | 20 | 2.5 | 2.5 | 2 | — | 0.5 | 0.5 | 0.3 | — | REMAINDER | 100 | 19 | 0.07 |
| 3 | 30 | 2.5 | 3 | 2 | 2 | — | — | 0.3 | — | REMAINDER | 120 | 18 | 0.06 |
| 4 | 40 | 3 | 2 | 1.5 | — | 1 | 4 | 0.4 | — | REMAINDER | 130 | 15 | 0.07 |
| 5 | 30 | 0.3 | 2.5 | 1.5 | — | 3 | — | 0.1 | — | REMAINDER | 100 | 24 | 0.06 |
| 6 | 25 | 6 | 2 | 2 | 0.5 | 2.5 | — | 0.9 | — | REMAINDER | 120 | 13 | 0.08 |
| 7 | 35 | 5 | 0.1 | 2.5 | — | — | 5 | 0.8 | — | REMAINDER | 120 | 17 | 0.08 |
| 8 | 20 | 3.5 | 5 | 1.5 | 1 | 1 | 1 | 0.4 | — | REMAINDER | 115 | 8 | 0.07 |
| 9 | 30 | 2.5 | 1.5 | 0.1 | — | 2 | 2 | 0.3 | — | REMAINDER | 120 | 17 | 0.06 |
| 10 | 25 | 2 | 2.5 | 3 | 1 | — | 3 | 0.4 | — | REMAINDER | 110 | 10 | 0.07 |
| 11 | 30 | 1.5 | 4 | 1 | 0.1 | — | — | 1 | — | REMAINDER | 100 | 19 | 0.08 |
| 12 | 25 | 3 | 0.5 | 1.5 | — | 0.1 | — | 0.03 | — | REMAINDER | 105 | 22 | 0.05 |
| 13 | 25 | 1.5 | 3 | 1 | — | — | 0.1 | 0.4 | — | REMAINDER | 105 | 19 | 0.07 |
| 14 | 30 | 2 | 2.5 | 2.5 | 1 | 3 | 1 | 0.3 | — | REMAINDER | 120 | 15 | 0.07 |
| 15 | 35 | 1.5 | 3 | 0.5 | — | 3 | — | 0.1 | 0.3 | REMAINDER | 120 | 13 | 0.06 |
| 16 | 30 | 2.5 | 2.5 | 1.5 | — | 2 | — | 0.4 | 1.5 | REMAINDER | 120 | 10 | 0.06 |
| 17 | 25 | 1.5 | 1 | 1.5 | 1 | 2 | 1 | 0.8 | 3 | REMAINDER | 115 | 7 | 0.08 |
| | | | | | | COMPARATIVE Cu-BASED SINTERED ALLOY | | | | | | | |
| 1 | 8* | 3 | 2.5 | 1.5 | — | 3 | — | 0.4 | — | REMAINDER | 50 | 83 | 0.04 |
| 2 | 30 | 0.1* | 2.5 | 1 | 1 | 1 | 1 | 0.4 | — | REMAINDER | 45 | 88 | HEAT DAMAGE |
| 3 | 25 | 2.5 | —* | 1 | 4 | — | — | 0.3 | — | REMAINDER | 95 | 51 | 0.04 |
| 4 | 30 | 2 | 2.5 | —* | — | — | 3 | 0.3 | — | REMAINDER | 90 | 62 | 0.04 |
| 5 | 25 | 1.5 | 3 | 1.5 | —* | —* | —* | 0.5 | — | REMAINDER | 80 | 45 | 0.05 |
| 6 | 30 | 3 | 1.5 | 2 | 0.05 | 0.1 | — | 0.014* | — | REMAINDER | 90 | 92 | HEAT DAMAGE |
| 7 | 25 | 3 | 2.5 | 2 | — | 1 | — | 1.26* | — | REMAINDER | 55 | 31 | 0.05 |
| | | | | | | CONVENTIONAL Cu-BASED SINTERED ALLOY | | | | | | | |
| | 25 | 4 | — | — | — | — | — | — | — | REMAINDER | 35 | 93 | 0.05 |

(*OUT OF RANGE OF INVENTION)

TABLE 4

| TYPE | BLENDED COMPOSITION (wt %) Zn | Al | Mn | Si | W | Mo | OXYGEN | Fe | Ni | Co | Sn | Cr | Cu + IMPURITY | PRESSURE DESTRUCTIVE LOAD (Kg) | SPECIFIC WEAR AMOUNT ($\times 10^{-7}$ mm²/Kg · m) | FRICTION COEFFICIENT |
|---|---|---|---|---|---|---|---|---|---|---|---|---|---|---|---|---|
| Cu-BASED SINTERED ALLOY ACCORDING TO INVENTION | | | | | | | | | | | | | | | | |
| 1 | 10 | 3 | 2.5 | 1.5 | 1 | — | 0.4 | — | — | — | — | — | REMAINDER | 85 | 16 | 0.07 |
| 2 | 20 | 3 | 2.5 | 1.5 | — | 0.5 | 0.3 | — | — | — | — | — | REMAINDER | 95 | 18 | 0.07 |
| 3 | 30 | 2.5 | 3 | 1 | 1 | 1 | 0.4 | — | — | — | — | — | REMAINDER | 115 | 15 | 0.06 |
| 4 | 40 | 2.5 | 2 | 2 | — | 1 | 0.4 | — | — | — | — | — | REMAINDER | 125 | 16 | 0.07 |
| 5 | 25 | 0.3 | 3 | 1.5 | 2 | — | 0.1 | — | — | — | — | — | REMAINDER | 95 | 23 | 0.06 |
| 6 | 30 | 6 | 2.5 | 1 | — | 3 | 0.9 | — | — | — | — | — | REMAINDER | 110 | 12 | 0.08 |
| 7 | 30 | 2.5 | 0.1 | 1.5 | 0.5 | 0.5 | 0.4 | — | — | — | — | — | REMAINDER | 90 | 16 | 0.07 |
| 8 | 25 | 3 | 5 | 1.5 | 3 | — | 0.3 | — | — | — | — | — | REMAINDER | 115 | 8 | 0.07 |
| 9 | 30 | 2.5 | 3 | 0.1 | 1 | — | 0.3 | — | — | — | — | — | REMAINDER | 95 | 18 | 0.06 |
| 10 | 30 | 2 | 3 | 3 | — | 2 | 0.4 | — | — | — | — | — | REMAINDER | 120 | 10 | 0.06 |
| 11 | 25 | 3 | 2.5 | 1.5 | 0.1 | — | 0.3 | — | — | — | — | — | REMAINDER | 105 | 19 | 0.06 |
| 12 | 20 | 5 | 2.5 | 1 | — | 0.1 | 0.6 | — | — | — | — | — | REMAINDER | 100 | 17 | 0.07 |
| 13 | 30 | 1 | 0.5 | 0.5 | — | 1 | 0.03 | — | — | — | — | — | REMAINDER | 95 | 20 | 0.05 |
| 14 | 25 | 3.5 | 1.5 | 1 | 3 | — | 1 | — | — | — | — | — | REMAINDER | 110 | 9 | 0.08 |
| 15 | 40 | 5.5 | 4.5 | 2.5 | 2 | 1 | 0.8 | 3 | — | — | — | — | REMAINDER | 115 | 7 | 0.08 |
| 16 | 25 | 0.5 | 0.3 | 0.3 | — | 0.2 | 0.1 | — | 1 | — | — | — | REMAINDER | 105 | 21 | 0.06 |
| 17 | 25 | 3.5 | 2.5 | 3 | 0.5 | 3 | 0.3 | — | — | 0.1 | — | — | REMAINDER | 95 | 15 | 0.08 |
| 18 | 30 | 2 | 3 | 2.5 | 2 | — | 0.3 | 3 | 2 | — | — | — | REMAINDER | 105 | 10 | 0.06 |
| 19 | 30 | 2 | 2 | 1 | 1.5 | 2 | 0.4 | — | — | — | 0.1 | — | REMAINDER | 105 | 14 | 0.07 |
| 20 | 25 | 4.5 | 3 | 1 | 1 | — | 0.5 | — | — | — | 3 | — | REMAINDER | 120 | 11 | 0.07 |
| 21 | 30 | 3 | 1 | 0.5 | — | 3 | 0.3 | — | — | — | — | 0.1 | REMAINDER | 100 | 17 | 0.06 |
| 22 | 35 | 1 | 3 | 1 | 1 | 2 | 0.2 | — | — | — | — | 3 | REMAINDER | 95 | 10 | 0.05 |
| 23 | 25 | 2 | 2.5 | 1.5 | 1 | 0.5 | 0.3 | — | — | 5 | 1 | — | REMAINDER | 100 | 8 | 0.06 |
| 24 | 20 | 1.5 | 3 | 1.5 | — | 2.5 | 0.2 | 1 | 1 | 1 | 0.5 | — | REMAINDER | 95 | 11 | 0.06 |
| 25 | 25 | 3 | 4 | 2.5 | — | 1 | 0.5 | 4 | — | — | — | 0.5 | REMAINDER | 105 | 10 | 0.07 |
| 26 | 20 | 2 | 1 | 1 | 0.5 | 0.5 | 0.7 | — | 2 | 1 | — | 2 | REMAINDER | 100 | 8 | 0.07 |
| 27 | 30 | 2.5 | 0.5 | 2 | 1 | 1.5 | 0.4 | — | — | — | 2 | 1 | REMAINDER | 110 | 9 | 0.06 |
| 28 | 35 | 1.5 | 2.5 | 1 | — | 1 | 0.4 | — | 0.1 | — | 0.5 | 0.5 | REMAINDER | 105 | 13 | 0.06 |
| 29 | 30 | 1 | 3.5 | 1.5 | — | 2 | 0.8 | 0.5 | — | 1 | 1 | 1 | REMAINDER | 100 | 9 | 0.07 |
| 30 | 30 | 1.5 | 4 | 2 | 0.2 | 1.5 | 0.4 | 1 | 2 | 0.5 | 4 | 1 | REMAINDER | 110 | 6 | 0.06 |
| COMPARATIVE Cu-BASED SIN ALLOY | | | | | | | | | | | | | | | | |
| 1 | 7* | 3 | 2 | 1 | 1 | 1 | 0.3 | — | — | — | — | — | REMAINDER | 45 | 78 | 0.03 |
| 2 | 25 | 2.5 | —* | 3 | 1 | 2 | 0.4 | — | — | — | — | — | REMAINDER | 90 | 45 | 0.05 |
| 3 | 30 | 2.5 | 1 | —* | 1 | — | 0.3 | — | — | — | — | — | REMAINDER | 90 | 47 | 0.05 |
| 4 | 25 | 2 | 2 | 1 | —* | —* | 0.4 | — | — | — | — | — | REMAINDER | 105 | 49 | 0.06 |
| 5 | 30 | 1.5 | 1 | 1 | — | 2 | 0.01* | — | — | — | — | — | REMAINDER | 95 | 86 | HEAT DAMAGE |
| 6 | 25 | 2.5 | 2 | 1 | 1 | 1 | 1.4* | — | — | — | — | — | REMAINDER | 50 | 28 | 0.05 |
| CONVENTIONAL Cu-BASED SINTERED ALLOY | | | | | | | | | | | | | | | | |
| | 28 | 6 | — | — | — | — | — | — | — | — | — | — | REMAINDER | 40 | 95 | 0.06 |

(*OUT OF RANGE OF INVENTION)

We claim:

1. A Cu-based sintered alloy comprising a composition which contains on weight basis:

Zn in an amount from 10–40%, Al in an amount from 03.–6%, oxygen in the form of oxides, in an amount from 0.3–1%;

at least one additional element selected from the group consisting of (a) at least one of Fe, Ni and Co in an amount from 0.1–5%, (b) Mn in an amount from 0.1–5%, (c) Si in an amount from 0.1–3% and (d) at least one of W and Mo in an amount from 0.1–3%; and the remaining consisting of Cu and inevitable impurities;

said alloy having a structure in the matrix of which the oxides are distributed with a granule size ranging from 1 to 40 μm, said intermetallic compounds being distributed with a granular size from 1 to 25 μm.

2. The alloy of claim 1 having a structure in the matrix of which the oxides comprise 0.5–15% of the surface area ratio, said intermetallic compounds being uniformly dispersed and comprising 1–10% of the surface area ratio.

3. The Cu-based sintered alloy as claimed in claim 1, wherein said additional element is 0.5–5 weight % of at least one selected from the group consisting of Fe, Ni and Co.

4. The Cu-based sintered alloy as claimed in claim 3, further comprising 0.1–5 weight % Mn.

5. The Cu-based sintered alloy as claimed in claim 3, further comprising 0.1–5 weight % of at least one element selected from the group consisting of W, Mo and Cr.

6. The Cu-based sintered alloy as claimed in claim 3, further comprising 0.1–4 weight % Sn.

7. The Cu-based sintered alloy as claimed in claim 3, further comprising 0.1–5 weight % Mn and 0.1–5 weight % of at least one of W, Mo and Cr.

8. The Cu-based sintered alloy as claimed in claim 3, further comprising 0.1–5 weight % Mn and 0.1–4 weight % Sn.

9. The Cu-based sintered alloy as claimed in claim 3, further comprising 0.1–4 weight % Sn and 0.1–5 weight % of at least one of W, Mo and Cr.

10. The Cu-based sintered alloy as claimed in claim 3, further comprising 0.1–5 weight % Mn, 0.1–4 weight % Sn and 0.1–5 weight % of at least one element selected from the group consisting of W, Mo and Cr.

11. The Cu-based sintered alloy as claimed in claim 3, further comprising 0.1–3 weight % Si and 0.1–3 weight % of at least one element selected from the group consisting of W and Mo.

12. The Cu-based sintered alloy as claimed in claim 3, further comprising 0.1–3 weight % Si, 0.1–4 weight % Sn, and 0.1–3 weight % of at least one of W and Mo.

13. The Cu-based sintered alloy as claimed in claim 3, further comprising 0.1–3 weight % Si, 0.1–3 weight % Cr and 0.1–3 weight % of at least one of W and Mo.

14. The Cu-based sintered alloy as claimed in claim 3, further comprising 0.1–3 weight % Si, 0.1–4 weight % Sn, 0.1–3 weight % and 0.1–3 weight % of at least one of W and Mo.

15. The Cu-based sintered alloy as claimed in claim 3, further comprising 0.1–5 weight % Mn and 0.1–3 weight % Si.

16. The Cu-based sintered alloy as claimed in claim 3, further comprising 0.1–5 weight % Mn, 0.1–3 weight % Si and 0.1–3 weight % Cr.

17. The Cu-based sintered alloy as claimed in claim 1, wherein said additional elements are 0.1–3 weight % Mn, 0.1–3 weight % Si, and 0.1–3 weight % of at least one of W and Mo.

18. The Cu-based sintered alloy as claimed in claim 17, further comprising 0.1–5 weight % of at least one of Fe, Ni and Co.

19. The Cu-based sintered alloy as claimed in claim 17, further comprising 0.1–4 weight % of Sn.

20. The Cu-based sintered alloy as claimed in claim 17, further comprising 0.1–3 weight % Cr.

21. The Cu-based sintered alloy as claimed in claim 17, further comprising 0.1–4 weight % Sn and 0.1–5 weight % of at least one of Fe, Ni and Co.

22. The Cu-based sintered alloy as claimed in claim 17, further comprising 0.1–3 weight % Cr and 0.1–5 weight % of at least one of Fe, Ni and Co.

23. The Cu-based sintered alloy as claimed in claim 17, further comprising 0.1–4 weight % Sn and 0.1–3 weight % Cr.

24. The Cu-based sintered alloy as claimed in claim 17, further comprising 0.1–4 weight % Sn, 0.1–3 weight % Cr and 0.1–5 weight % of at least one of Fe, Ni and Co.

25. A part for automotive equipment formed of the Cu-based sintered alloy as claimed in any one of claims 1 to 24, and which is used in a portion which suffers wear in air within the range of the ordinary temperature to 400° C.

26. A part for automotive equipment as claimed in claim 25, wherein the part is a synchronizer ring for a transmission.

27. A part for automotive equipment as claimed in claim 25, wherein the part is a valve-guide for an engine.

28. A part for automotive equipment as claimed in claim 25, wherein the part is a bearing for a turbocharger.

* * * * *

UNITED STATES PATENT AND TRADEMARK OFFICE

CERTIFICATE OF CORRECTION

PATENT NO. : 5,114,468

DATED : May 19, 1992

INVENTOR(S) : Hidetoshi Akutsu, et al.

It is certified that error appears in the above-identified patent and that said Letters Patent is hereby corrected as shown below:

Title page item [54] and col. 1, in the title should read as --CU-BASED--

In the Abstract, line 14: "Cu-Base" should read as --Cu-Based--

Column 1, line 50: "Zn" should read as --Zn:--

Column 4, line 20: "The Cr ..." should begin a new paragraph.

Column 5, line 6: "with in" should read as --with ※ in--

Column 6, line 4: "with in" should read as --with ※ in--

Column 6, line 68: "with TABLE" should read as --with ※ in TABLE--

Column 7, line 45: delete second occurrence of --2.--

Column 7, line 68: "with in" should read as --with ※ in--

Column 8, lines 58-59: "members" should read as --members.--

Column 9, line 48, Table 1: "(* OUT" should read as --( ※ : OUT--

UNITED STATES PATENT AND TRADEMARK OFFICE

CERTIFICATE OF CORRECTION

PATENT NO. : 5,114,468

DATED : May 19, 1992

INVENTOR(S) : Hidetoshi Akutsu, et al.

It is certified that error appears in the above-identified patent and that said Letters Patent is hereby corrected as shown below:

Column 11, line 33, Table 2: "(* OUT" should read as --( ※ : OUT--

Column 11, line 66, Table 3: "(* OUT" should read as --( ※ : OUT--

Column 13, line 41, Table 4: "(* OUT" should read as --( ※ : OUT--

Column 13, line 47, Claim 1: "03" should read as --0.3--

Column 14, line 40, Table 4: "0 06" should read as --0.06--

Column 15, line 12, Claim 14: "% and" should read as --% Cr and--

Signed and Sealed this

Fourteenth Day of September, 1993

Bruce Lehman

*Attest:*

*Attesting Officer*

BRUCE LEHMAN

*Commissioner of Patents and Trademarks*